US007992658B2

(12) United States Patent
Buske

(10) Patent No.: US 7,992,658 B2
(45) Date of Patent: Aug. 9, 2011

(54) PILOT REAMER WITH COMPOSITE FRAMEWORK

(75) Inventor: Robert J. Buske, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 8 days.

(21) Appl. No.: 12/268,920

(22) Filed: Nov. 11, 2008

(65) Prior Publication Data

US 2010/0116556 A1 May 13, 2010

(51) Int. Cl.
*E21B 10/28* (2006.01)

(52) U.S. Cl. ..... 175/385; 175/334

(58) Field of Classification Search ..... 175/57, 175/334, 335, 385, 386; 76/108.4
See application file for complete search history.

(56) References Cited

U.S. PATENT DOCUMENTS

| | | | | | |
|---|---|---|---|---|---|
| 1,399,831 | A | | 12/1921 | Wadsworth | |
| 2,019,047 | A | * | 10/1935 | Grant | 175/267 |
| 2,030,722 | A | | 2/1936 | Scott | |
| 2,058,628 | A | | 10/1936 | Reed | |
| 2,085,336 | A | * | 6/1937 | Sandstone | 175/104 |
| 2,086,680 | A | | 7/1937 | Scott et al. | |
| 2,103,583 | A | | 12/1937 | Howard et al. | |
| 2,249,926 | A | | 7/1941 | Zublin | |
| 2,716,018 | A | * | 8/1955 | Williams | 175/98 |
| 2,754,088 | A | * | 7/1956 | Kammerer, Jr. | 175/290 |
| 3,285,355 | A | | 11/1966 | Neilson et al. | |
| 3,342,276 | A | * | 9/1967 | Beck, Jr. | 175/286 |
| 3,386,521 | A | | 6/1968 | Chadderdon et al. | |
| 3,489,211 | A | * | 1/1970 | Kammerer, Jr. | 166/361 |
| 3,917,011 | A | | 11/1975 | Hester | |
| 4,006,788 | A | | 2/1977 | Garner | |
| 4,036,314 | A | | 7/1977 | Dixon et al. | |
| 4,050,840 | A | | 9/1977 | Skingle | |
| 4,343,371 | A | | 8/1982 | Baker, III et al. | |
| 4,915,181 | A | | 4/1990 | Labrosse | |
| 5,302,005 | A | * | 4/1994 | O'Neill | 299/87.1 |
| 5,337,843 | A | | 8/1994 | Torgrimsen et al. | |
| 5,429,201 | A | | 7/1995 | Saxman | |
| 5,485,888 | A | * | 1/1996 | England | 175/53 |
| 5,979,574 | A | * | 11/1999 | Osadchuk | 175/353 |
| 5,992,542 | A | | 11/1999 | Rives | |
| 6,318,480 | B1 | * | 11/2001 | Hearn | 175/61 |

(Continued)

OTHER PUBLICATIONS

Buske, R., Rickabaugh, C., Bradford, J., Lukasewich, H. and Overstreet, J. "Performance Paradigm Shift: Drilling Vertical and Directional Sections Through Abrasive Formations with Roller Cone Bits." Society of Petroleum Engineers—SPE 114975, CIPC/SPE Gas Technology Symposium 2008 Joint Conference, Jun. 16-19, 2008, Canada.

(Continued)

*Primary Examiner* — Shane Bomar
*Assistant Examiner* — Robert E Fuller
(74) *Attorney, Agent, or Firm* — Locke Lord Bissell & Liddell LLP

(57) ABSTRACT

A reamer for subterranean wellbores may include a composite framework, which may include one or more high strength stems, each having one or more reamer bodies coupled thereto. The body may include a plurality of plates coupled together and may include additional components formed integrally therewith or coupled thereto. A method of forming a reaming tool may include forming a high strength stem and a reamer body and coupling the body to the stem. A method of using the reaming tool may include coupling one or more bodies in a drill string and reaming a wellbore.

4 Claims, 9 Drawing Sheets

U.S. PATENT DOCUMENTS

| | | | | |
|---|---|---|---|---|
| 6,360,831 | B1 | 3/2002 | Akesson et al. | |
| 6,386,298 | B1 | 5/2002 | Smith et al. | |
| 6,386,302 | B1 | 5/2002 | Beaton | |
| 6,527,066 | B1 | 3/2003 | Rives | |
| 6,729,418 | B2 | 5/2004 | Slaughter, Jr. et al. | |
| 6,742,607 | B2 | 6/2004 | Beaton | |
| 6,745,858 | B1 | 6/2004 | Estes | |
| 6,902,014 | B1 | 6/2005 | Estes | |
| 6,926,100 | B1 | 8/2005 | Anthony et al. | |
| 7,108,082 | B1 | 9/2006 | Anthony et al. | |
| 7,111,694 | B2 | 9/2006 | Beaton | |
| 7,131,794 | B2 * | 11/2006 | Robinson et al. | 407/50 |
| 7,152,702 | B1 * | 12/2006 | Bhome et al. | 175/384 |
| 7,243,737 | B2 * | 7/2007 | Michael | 175/53 |
| 7,350,596 | B1 | 4/2008 | Attaya | |
| 7,416,036 | B2 | 8/2008 | Forstner et al. | |
| 2002/0088649 | A1 * | 7/2002 | Morris et al. | 175/334 |
| 2002/0108785 | A1 | 8/2002 | Slaughter, Jr. et al. | |
| 2004/0060741 | A1 | 4/2004 | Shipalesky et al. | |
| 2006/0260848 | A1 | 11/2006 | Fyfe | |
| 2009/0166093 | A1 * | 7/2009 | Pessier et al. | 175/335 |
| 2009/0218140 | A1 * | 9/2009 | Pessier et al. | 175/57 |
| 2010/0078223 | A1 * | 4/2010 | Buske | 175/325.5 |

OTHER PUBLICATIONS

Smith Services, Hole Opener—Model 6980 Hole Opener, unknown Internet page, unknown date.

Hole Opener Corporation, RHO Hole Opener, unknown Internet page, unknown date.

Epley Enterprises, Inc., epley percussion hole openers, unknown Internet page, unknown date.

Kim, D.J., International Search Report for International Patent Application No. PCT/US2009/063810, Korean Intellectual Property Office, dated May 13, 2010.

Kim, D.J., Written Opinion for International Patent Application No. PCT/US2009/063810, Korean Intellectual Property Office, dated May 13, 2010.

* cited by examiner

PILOT REAMER WITH COMPOSITE FRAMEWORK

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to tools for reaming wellbores; and more specifically relate to the structure and manufacture of the framework of reamer tools.

2. Description of the Related Art

Drill bits used to drill wellbores through earth formations typically have a nominal cutting diameter, such as a diameter roughly equal to the diameter of the remaining borehole once the drill bit passes through some portion of earth. Frequently, it may be desirable to enlarge the diameter of the borehole beyond the nominal diameter of the drill bit. A pilot reamer, at least in part, may be used to accomplish such a task.

For example, U.S. Pat. No. 6,386,302 to Beaton discloses a "reamer for drilling a hole having a diameter larger than a pass through diameter [and] in one aspect includes a body having reaming blades affixed at azimuthally spaced apart locations."

As another example, U.S. Pat. No. 7,416,036 to Forstner et al., which is assigned to the assignee of the present invention, discloses a "BHA compris[ing] a pilot bit and a reamer above it that is larger in diameter than the suspended liner."

The inventions disclosed and taught herein are directed to an improved tool for reaming having a composite framework and to methods of making and using the improved tool.

BRIEF SUMMARY OF THE INVENTION

A reamer for subterranean wellbores is disclosed, wherein the reamer may include a composite framework. The framework may include a stem, which may include one or more portions, having an upper end and a lower end. The framework may further include a body having one or more radially disposed receptacles, which may receive one or more components for reaming a wellbore. The components may include stabilizers or cutting elements, such as fixed blades or radially disposed arms having cones, such as to define a reaming diameter. One or more bodies may be coupled along the length of the stem. At least one embodiment of the pilot reamer may include a tubular stem having upper and lower ends with a cylindrical portion therebetween, wherein each end has a connector, such as a threaded end, or other coupler, and wherein the stem may have a shoulder proximate the upper end. The reamer may further include a tubular body having a top and a bottom, which may be comprised of a plurality of plates coupled together. The plates may define an internal passage and a plurality of radially disposed components, such as pads or receptacles. The body may be coupled to the stem, for example, so that the top of the body is adjacent to the shoulder of the stem. The reamer may further include a tube coupled between the body and the stem. Other exemplary embodiments of the reamer may include a stem having two portions, wherein the body is coupled between the two portions, or, as another example, more than one body coupled to a stem and/or in a drill string.

A method of forming a pilot reamer is also disclosed. The method may include forming a tubular stem having upper and lower ends. The method may also include forming a shoulder between the two ends of the stem, for example a shoulder extending radially outwardly from the longitudinal axis or circumference of the stem. The method may include forming a tubular reamer body having upper and lower ends, for example, by coupling a plurality of plates together. Forming the body may include defining an internal passage, one or more diameters, such as a cutting diameter, and/or a plurality of radially or otherwise disposed formations. The method may also include coupling the reamer body to the stem. The body may be coupled anywhere along the stem, for example, so that the upper end of the body is adjacent to the shoulder of the stem. The body may be coupled to the stem removably, permanently or otherwise.

Another method of forming the composite reamer is disclosed. The method may include forming a tubular stem having upper and lower portions. The method may further include forming a reamer body and coupling the body between the upper and lower portions of the stem. A method of using the present inventions is also disclosed. The method may include providing one or more composite reamers, coupling each reamer in a drill string, and rotating the reamers to ream the wellbore.

DETAILED DESCRIPTION OF THE INVENTION

Figure 1:
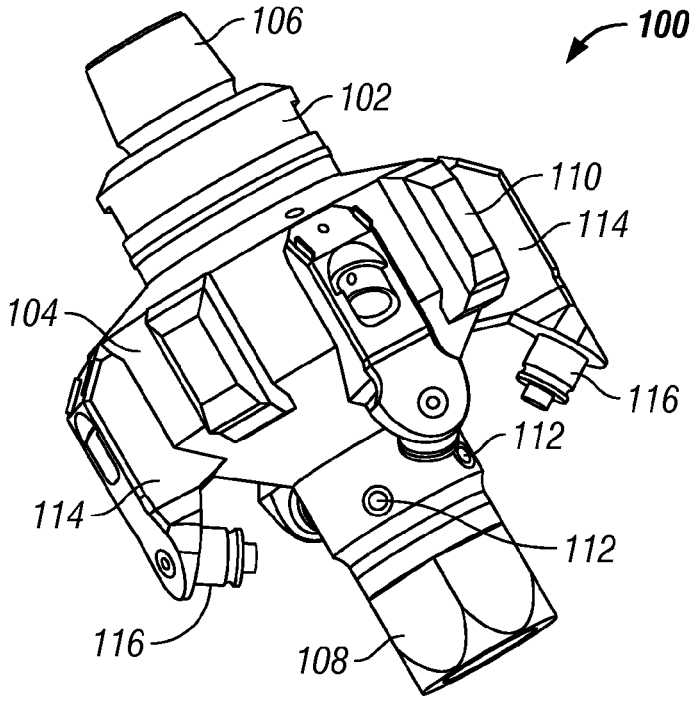
FIG. 1 illustrates one of many embodiments of a pilot reamer utilizing certain aspects of the present inventions.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in the art having the benefits of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. The term "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together, removably or otherwise, and can further include without limitation integrally forming one functional member with another in a unity fashion. The coupling can occur in any direction, including rotationally.

I have created a pilot reamer having a composite framework and methods of making and using the reamer. The framework may include a stem for supporting one or more components of the reamer and for coupling the reamer into a drill string, which may include pipe, the bottom hole assembly ("BHA"), and/or other downhole equipment. The stem may be made from any material, and may comprise one or more sections, which may be cylindrical. The stem may preferably be formed from high strength steel, but need not be. The stem may be tubular, such as to allow fluid to flow therethrough, and may include a connector, or coupler, at one or both ends, such as, for example, an American Petroleum Institute ("API") pin or box connector, for coupling the reamer in place or, as another example, to other components. The stem may further include other components required by a particular application, such as other connectors, or a shoulder, such as for positioning components on the stem. As another example, the stem may include fluid orifices for directing fluid to a desired location. For example, the orifices may include jets, such as for jetting cuttings, cleaning or cooling. The components may be formed in any manner, such as integrally with the stem, as modifications thereto or, as another example, they may be manufactured separately and coupled to the stem.

The framework may also include a body for contacting the wellbore, such as, for example, to ream the wellbore, which may include enlarging the bore hole and/or otherwise contacting the hole wall, such as to stabilize one or more pieces of downhole equipment, for example. Reaming is used broadly herein and may occur in any direction and over any period of time, constantly or intermittently. One or more bodies may be coupled to the stem, each of which may be made from the same material as the stem, or a different material. The body may be coupled in any manner required by a particular application, such as by welding, threading, pinning, and/or other methods. In at least one embodiment, the body may be made from two or more plates coupled together. The body may define one or more profiles, such as pads or blades. As another example, the body may include receptacles, such as for the attachment of cutting elements, heads, holders, legs, stabilizers or other devices useful for reaming a wellbore. Some elements of the body, or portions thereof, may be formed integrally with the body, while others may be formed separately and coupled thereto. Furthermore, I have created methods of forming and using the pilot reamer. The methods may include the formation of two or more components, such as a stem or body, separately, simultaneously or otherwise, and may further include coupling those components in one or more fashions to form the reamer tool and/or ream the wellbore.

FIG. 1 illustrates one of many embodiments of a pilot reamer 100 utilizing certain aspects of the present inventions. The reamer 100 may include a stem 102 and a body 104. The reamer 100 may further include couplers or connectors, such as for coupling the reamer 100 within a drill string. The couplers may be integral with stem 102 or coupled thereto. In the exemplary embodiment of FIG. 1, the reamer 100 includes a pin connection 106 on the uphole end and a box connection 108 on the downhole end. However, these connections could be reversed, used singularly, or, as another example, could be replaced with any type of connection as may be required by a particular application. The body 104 may include one or more blocks 110, which may be, for example, stabilizers that extend radially relative to the central axis of the reamer 100. In an embodiment having stabilizers, for example, the stabilizers may extend such as to contact the borehole wall, constantly or intermittently, but need not do so. The blocks 110 may include radially disposed cutting elements or blades (not shown), such as to define a cutting diameter, which may be any diameter required by a particular application, for example, 22-28 inches. One or more blocks 110 may include one or more cutters, such as for example polycrystalline diamond compact ("PDC") or carbide inserts. In some embodiments, the blocks 110 may be gauge pads, or may serve other functions. The body 104 may further include supports, such as legs 114, for example, to support cutting elements, such as cones (not shown), and/or other equipment, such as heads 116, gaskets, seals or bearings. The supports may be formed in any manner, such as integrally with the body 104 or separately therefrom and attached thereto, singularly or in combination. The stem 102 may include orifices 112, for example, jets or ports, for allowing drilling fluid to flow to a desired location, such as from the interior to the exterior of the stem 102.

Each component of the reamer 100, such as those described above, may be attached to the stem 102 or body 104 permanently, removably, or otherwise. For example, the blocks 110 and legs 114 may be permanently welded to body 104, or they may be easily removable, such as using pins, screws, bolts, or the like. The components may be replaceable, interchangeable, or reusable and may be coupled to the body 104 in any order. In at least one exemplary embodiment, four blocks 110 and four legs 114 may preferably be coupled radially around the circumference of the body 104 in an alternating fashion, but they need not be. Alternatively, the components may be of any type useful for reaming wellbores, including blocks 110 and legs 114. The components may be coupled in any order and in any number.

Figure 2:
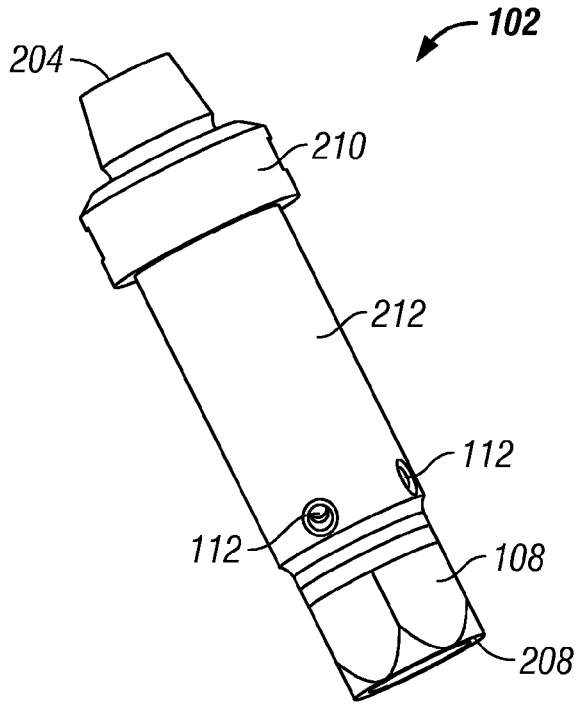
FIG. 2 illustrates one of many embodiments of a stem utilizing certain aspects of the present inventions.

FIG. 2 illustrates one of many embodiments of a stem 102 utilizing certain aspects of the present inventions. In this exemplary embodiment, the stem 102 may include a shaft 212, which may have a connection at either end, such as a pin connection 102 at the uphole end 204 and/or a box connection 108 at the downhole end 208. Stem 102 may include any connection required by a particular application at one or both ends, or none at all. One or more connections may be, for example, integral with stem 102, manufactured separately and later coupled to stem 102, or otherwise associated with stem 102. Stem 102 may be tubular, such as to allow fluid to flow internally from one end to the other. Also, stem 102 may include one or more orifices 112, for example, to allow fluid, such as drilling fluid, to flow from the interior to the exterior of the stem 102. The shaft 212 may include a shoulder 210 at some point along its length, for example, an annular extension wherein the outer diameter of the shoulder 210 may exceed the outer diameter of the shaft 212. The stem 102 may be made from any material, such as a metal or composite, and from any number of work pieces, considering such things as strength, cost or any other factor associated with a particular application.

Figure 3:
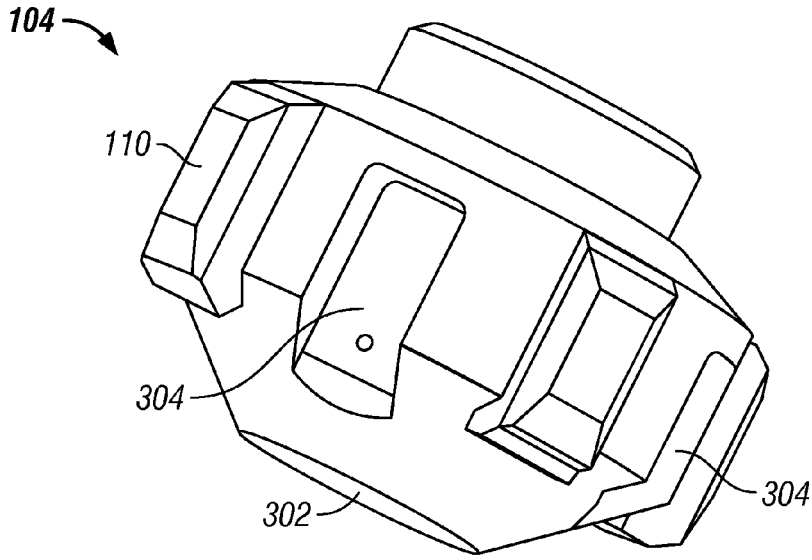
FIG. 3 illustrates one of many embodiments of a body utilizing certain aspects of the present inventions.

FIG. 3 illustrates one of many embodiments of a body 104 utilizing certain aspects of the present inventions. The body 104 may be tubular, having an internal passage 302, and may include one or more blocks 110. For example, the body 104 may have a plurality of blocks 110 that extend radially relative to the longitudinal axis of the body 104. One or more blocks 110 may be stabilizers, such as to contact the borehole wall, constantly, intermittently, or otherwise. As other examples, one or more blocks 110 may be pads, or may include cutters, such as PDC, carbide, or other cutters useful for reaming wellbores. The body 104 may further include legs 114 (not shown; see FIG. 1), such as to support bits or cones. For example, legs 114 may include heads having bearings, seals, or other desired equipment for reaming or drilling. The body 104 may be made of any material, such as a metal or composite. Further, the body 104 may be manufactured from a single piece of material or a plurality of pieces and may include components such as blocks 110 or, as other examples, legs 114, receptacles 304, or other couplers for coupling components to the body. Some components of the body 104 may be formed integrally therewith, while others may be formed separately and coupled thereto. While any particular component of the reamer 100 may be wholly integral or separate, the component need not be and may be formed by a combination of integral and independent components.

Figure 4:
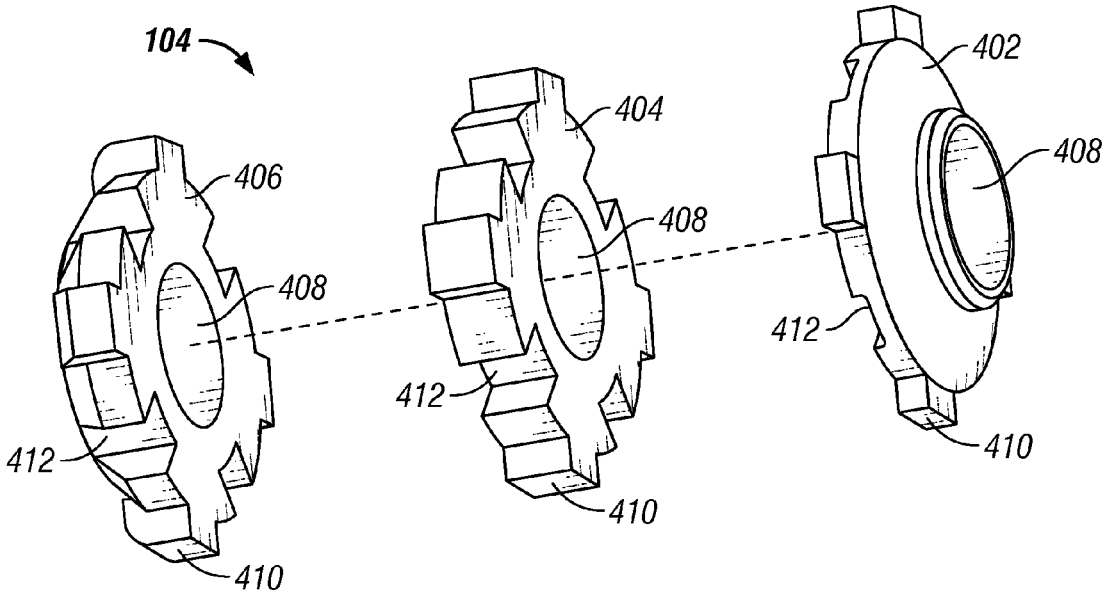
FIG. 4 illustrates one of many embodiments of a body composed of plates and utilizing certain aspects of the present invention.

FIG. 4 illustrates one of many embodiments of a body 104 composed of plates and utilizing certain aspects of the present invention. A body 104 may be manufactured from a plurality of pieces of material. The resulting body 104 may be similar to the body described above with respect to FIG. 3, but may be manufactured from two or more pieces or plates coupled together. For example, the body 104 may include upper plate 402, middle plate 404, and bottom plate 406. Each plate may have one or more profiles, such as internal profiles 408, block profiles 410 or, as another example, receptacle profiles 412. Each profile may be the same or different and may collectively form one or more attributes of the body 104. In at least one exemplary embodiment, the plates may be torch-cut plates, such as torch-cut steel, which may be cut to a particular shape and welded, laminated or otherwise coupled to one another to form the body 104. In some embodiments, for example, the plates may have mating profiles (not shown), such as pins, holes, grooves, or other parts, which may aid in aligning one plate relative to another or otherwise accomplishing a particular orientation. Embodiments such as those discussed above may have many advantages, for example, reducing parts or producing other desirable results in a particular application. For example, using a plurality of thinner plates to form the body 104 may be cheaper than using a single thicker plate and their use may further allow blades, stabilizers, or as another example receptacles 304 to be built integrally into the body 104, in whole or in part. Therefore, material costs may be reduced, as well as other costs, such as those related to machining, welding, coupling, finishing or other aspects of formation. Furthermore, such a method of manufacturing the body 104 may relieve size restraints, such as by allowing larger components than may be conventionally available or viable, financially or otherwise.

Figure 5:
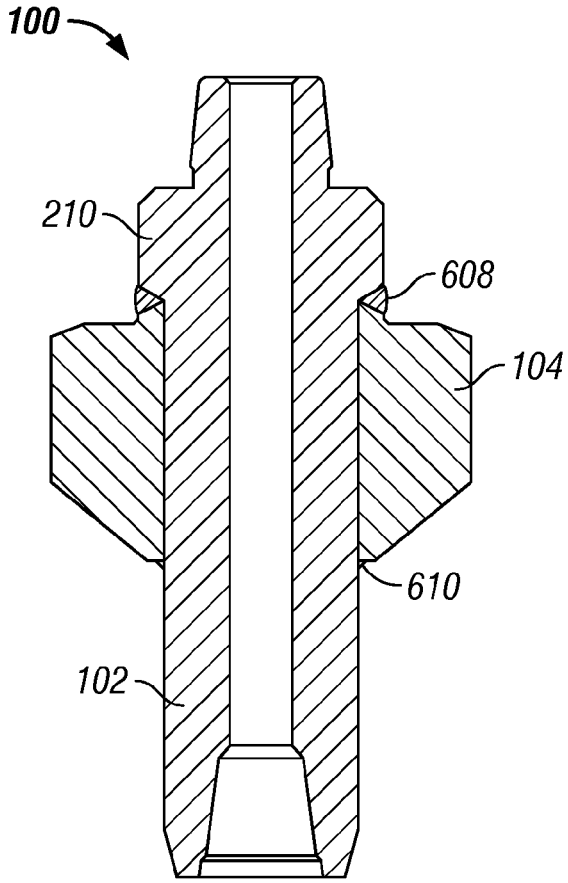
FIG. 5 illustrates a cross-section of one of many embodiments of the reamer featuring a stem and a body and utilizing certain aspects of the present invention.

FIG. 5 illustrates a cross-section of one of many embodiments of the reamer 100 featuring a stem 102 and a body 104 and utilizing certain aspects of the present invention. As discussed previously, a reamer 100 may be made using two or more separately formed components, such as a stem 102 and a body 104, made from one or more materials. In at least one preferred embodiment, the stem 102 may be formed from high strength material, such as, for example, 4145H steel or another high strength steel. The body 104 may be formed from the same or a different material, for example, low carbon steel, such as 8620 or 1018 steel. Such a composition may be advantageous or otherwise desirable for a particular application. For example, the composition may allow welding on the body without exceeding the heat limits of one or more components coupled to the body, such as heads containing seals. Conventional reamers may be made from a single work piece, which may require a substantial amount of heat for welding or joining purposes, such as an amount of heat great enough to compromise the integrity of some components. The present framework may overcome this and other shortcomings.

The components of the reamer 100 may be manufactured in any manner, such as casting, forging, or as another example, machining. One of skill in the art will appreciate that manufacturing decisions may be made according to the requirements of a particular application, considering such things as use, strength, costs or, as another example, material availability. In some embodiments, such as where the body 104 is composed of two or more plates, the plates may be cut to raw size, for example, by torch, water, laser or another method. Once the components of the reamer 100 are formed, they may be joined or coupled in any manner. For example, the stem 102 may be inserted into the internal passage of the body 104, such as until the shoulder 210 rests adjacent the body 104. The two components may be coupled to one another, such as by pinning, threading, press fitting or, for example, welding, singularly or in combination. In various embodiments, for example, welds may be placed at one or more locations, such as at seams 608 or 610, or there may be no welds at all.

Figure 6:
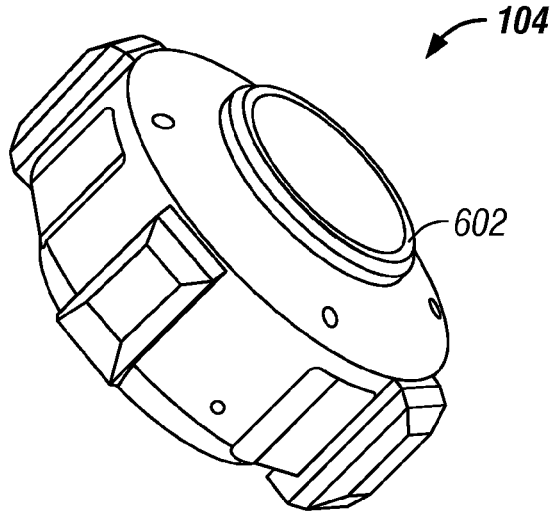
FIG. 6 illustrates another of many embodiments of a body having an additional coupler tube and utilizing certain aspects of the present invention.

FIG. 6 illustrates another of many embodiments of a body 104, the body 104 having an additional coupler tube 602 and utilizing certain aspects of the present invention. In addition to the characteristics described above, one or more embodiments of the body 104 may include a coupler tube 602, such as a pipe or other tubular member. The body 104 may be coupled to the tube 602 such that, for example, at least a portion of the interior surface of the body 104 is proximate to or adjacent to at least a portion of the exterior surface of the tube 602. The body 104 and tube 602 may be coupled in any manner, such as welding, pinning, fitting or another manner, singularly or in combination. In at least one embodiment, for example, the body 104 may be manufactured as desired, such as described above, and then positioned at any point along the length of the tube 602 and coupled thereto. In such an embodiment, for example, the inside diameter of the tube 602 may define the inside diameter of the body 104. This may allow, for example, the body 104 to be more easily or more efficiently coupled to the stem 102 in any desired manner, for example, by allowing for a simpler or more controlled fit, such as a shrink fit or other fit, between the interior of the body 104 or tube 602 and the exterior of the stem 102. Similar to the embodiments described previously, the body 104 having the tube 602 may be positioned on the stem 102, such as by sliding the tube 602 over at least a portion of the stem 102 until, for example, the uphole end of the body 104 and/or tube 602 contacts the shoulder 210 or reaches another position. Thereafter, the body 104 and tube 602 may be coupled to the stem, removably or otherwise, for example, by welding, mechanical means, or any method. The body 104 and/or tube 602 may be fixed at any position along the length of stem 102 or may be slideable between two or more positions. Moreover, the body 104 and/or tube 602 may be easily slideable along the outside surface of stem 102, but need not be. For example, the body 104 and/or tube 602 may be pressed or threaded onto the stem 102. Alternatively, the tube 602 may be coupled to the stem 102 before the body 104 is coupled to the tube 602. These components may be coupled in any manner and in any order.

Figure 7:
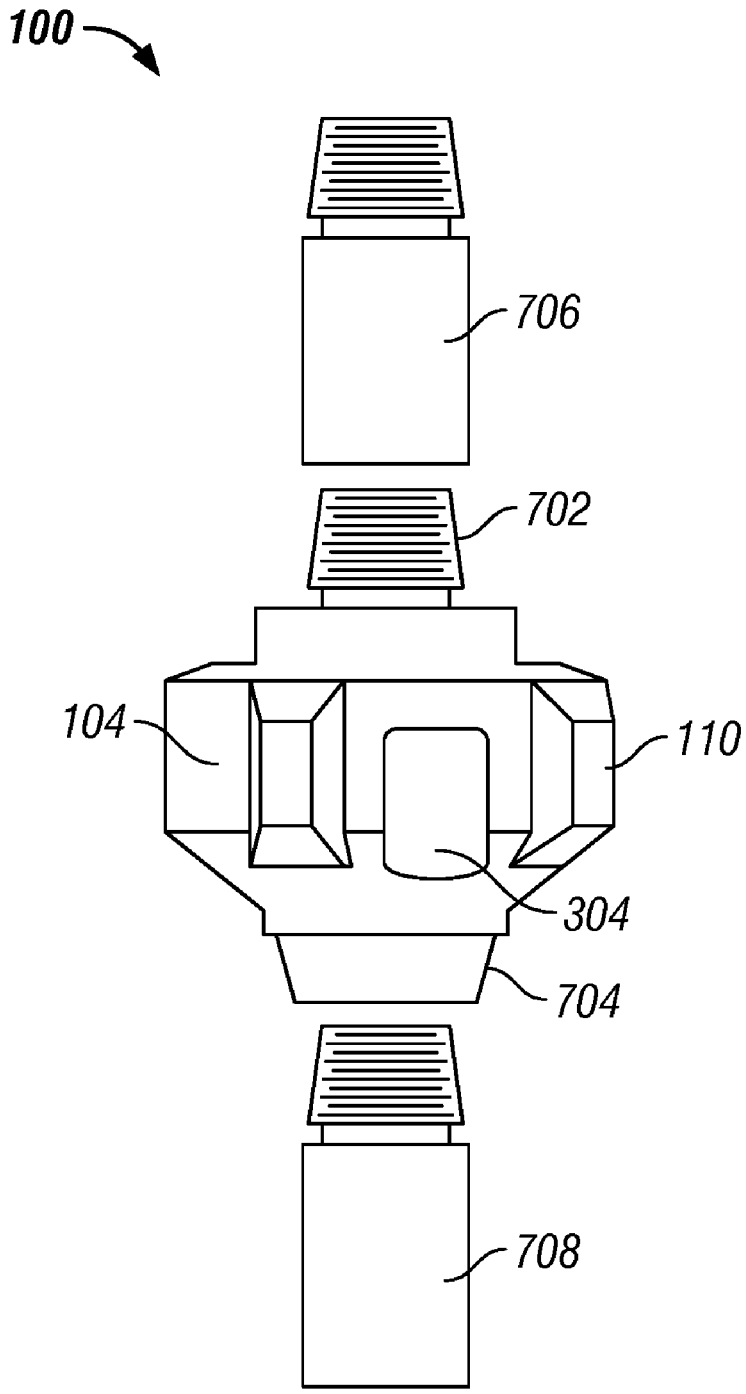
FIG. 7 illustrates another of many embodiments of the pilot reamer having upper and lower stems and utilizing certain aspects of the present invention.

FIG. 7 illustrates another of many embodiments of the pilot reamer 100 having upper and lower stems and utilizing certain aspects of the present invention. The body 104 may be similar to those embodiments described above, such as having blocks 110 or receptacles 304 formed therein or coupled thereto. Body 104 may further include upper connector 702 and lower connector 704. Connectors 702, 704 may be, for example, API pin and box connectors, or another type of connector required by a particular application. Connectors 702, 704 may be the same or different, and they may be coupled to the body 104, such as by welding, or they may preferably be formed integrally with the body 104. Reamer 100 may further include upper stem 706 and lower stem 708. Each stem 706, 708 may be formed from any material, which may be the same or a different material from one another. Each stem 706, 708 may preferably be formed from high strength steel, for example. One or more ends of each stem 706, 708 may have a connector, for example, so that one end of each stem can be coupled to the body 104. For example, in the embodiment of FIG. 7, the lower end of upper stem 706 may be coupled to connector 702 of the body 104 and the upper end of lower stem 708 may be coupled to connector 704. The free end of each stem 706, 708 may include any connection required by a particular application, such as to allow the reamer 100 to be coupled downhole in accordance with a particular application.

Figure 8:
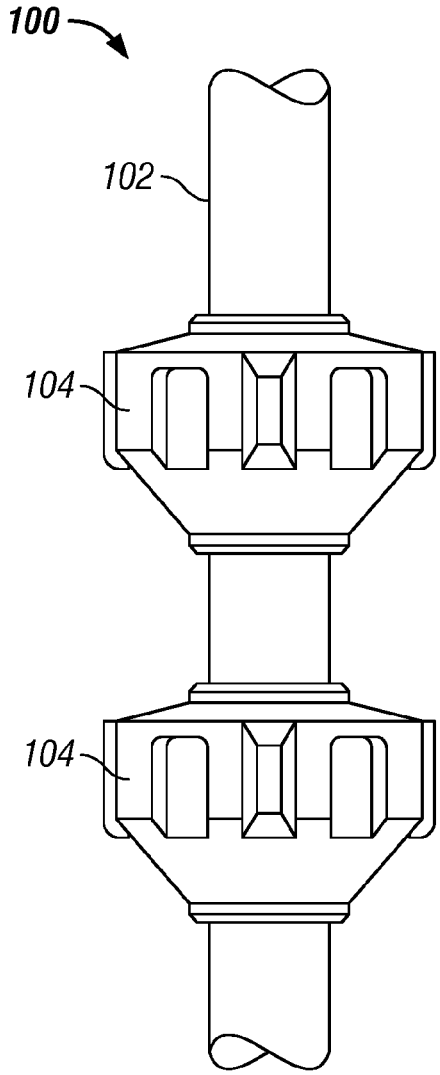
FIG. 8 illustrates one of many embodiments of the reamer having a stacked configuration and utilizing certain aspects of the present invention.

FIG. 8 illustrates one of many embodiments of the reamer 100 having a stacked configuration and utilizing certain aspects of the present invention. As larger hole drilling is required, for example, more than one reamer section can be used on an integral stem or two or more separate reamers can be coupled along the drill string. For example, in the exemplary embodiment of FIG. 8, reamer 100 may include a stem 102 having a plurality of bodies 104 coupled thereto. The bodies 104 may be of any form, such as one or more of the embodiments described above, and they may be of any diameter, different or the same. The exemplary embodiment of FIG. 8 shows two bodies 104 stacked on a single stem 102, however there could be any number of bodies 104 on the stem 102. The bodies 104 may have the same configuration, for example, a configuration described above, or they may have different configurations. For example, one body 104 may be configured for reaming the wellbore while another may be configured for stabilizing downhole equipment within the wellbore. The bodies 104 may be coupled anywhere along the stem 102, in any manner, as required by a particular application. For example, one or more bodies 104 may be adjacent one another, or they may be spaced apart as shown in FIG. 8 for exemplary purposes.

A lower body 104 may preferably have a cutting diameter larger than the pilot bit (not shown) and smaller than the upper body 104, but it need not. For example, in some applications requiring pilot bits, such as PDC bits, slip stick may occur, such as when the pilot bit is allowed to dig too deeply into the formation. One or more reamers 100, which may be less aggressive than the pilot bit, may be coupled uphole from the pilot bit. A reamer 100 may counteract the aggressiveness of the pilot bit, which may accomplish, for example, smoother overall drilling. For example, a more aggressive pilot bit may tend to want to drill faster than a reamer 100, which may result in the transfer of drilling weight to one or more reamers 100 from the pilot bit. The one or more reamers 100, for example, may drill better under increased weight and/or may not exhibit slip stick during operations, which may result in smoother operations.

Other applications may not include the use of a pilot bit. For example, the wellbore, or pilot hole, may be an existing drilled hole, such as a wellbore, mine, or other hole, wherein a pilot bit may not be necessary. For example, in a mine raising application, a pilot hole may already be present from one level to another in a mine. One or more reamers 100 may be coupled to the drill string at a lower level, for example, and drilling may occur in an uphole direction. The present invention may be advantageous in reducing or eliminating the need for drilling fluid to evacuate cuttings, reducing bottom hole pressure problems or, as another example, allowing gravity to keep the drilling surface clean.

Figure 9:
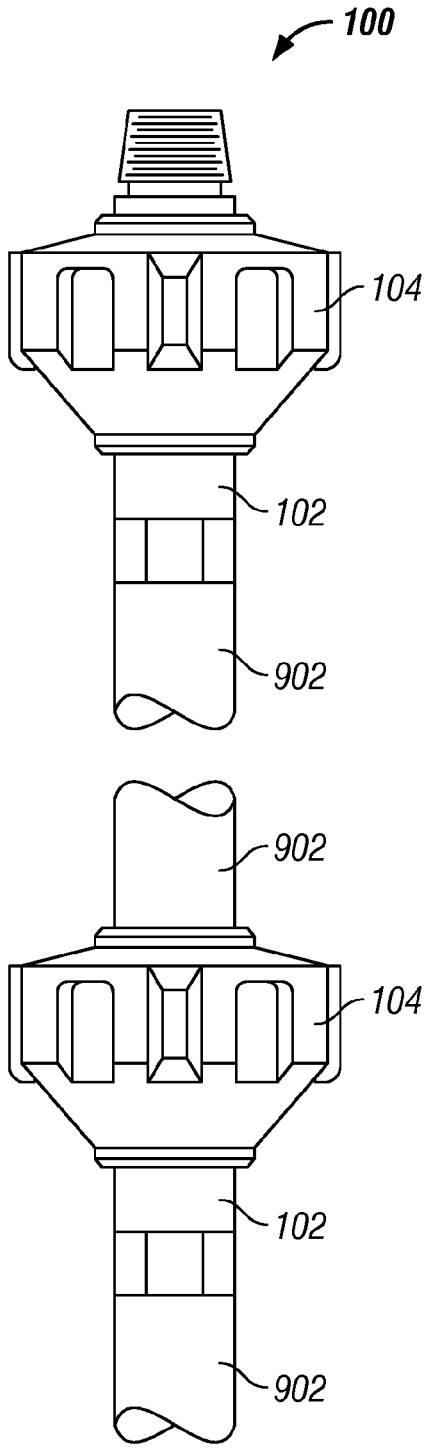
FIG. 9 illustrates another one of many embodiments of the reamer having a stacked configuration and utilizing certain aspects of the present invention.

FIG. 9 illustrates another one of many embodiments of the reamer 100 having another stacked configuration and utilizing certain aspects of the present invention. In this exemplary embodiment, a reamer 100 may include a plurality of stems 102 and bodies 104 coupled in any number of places along the drill string 902 as required by a particular application. Each stem 102 may include one or more bodies 104, each of which may be configured in any fashion required by a particular application. For example, reamers 100, such as one or more of those described herein, may be coupled to, or proximate to, the pilot bit (not shown), in the BHA, or elsewhere in a drill string. The reamers 100 of FIGS. 8 and 9 are shown for exemplary purposes and one of ordinary skill will understand that each reamer 100 may be of any form required by a particular application, such as one or more of those described herein, separately or in combination.

Figure 10:
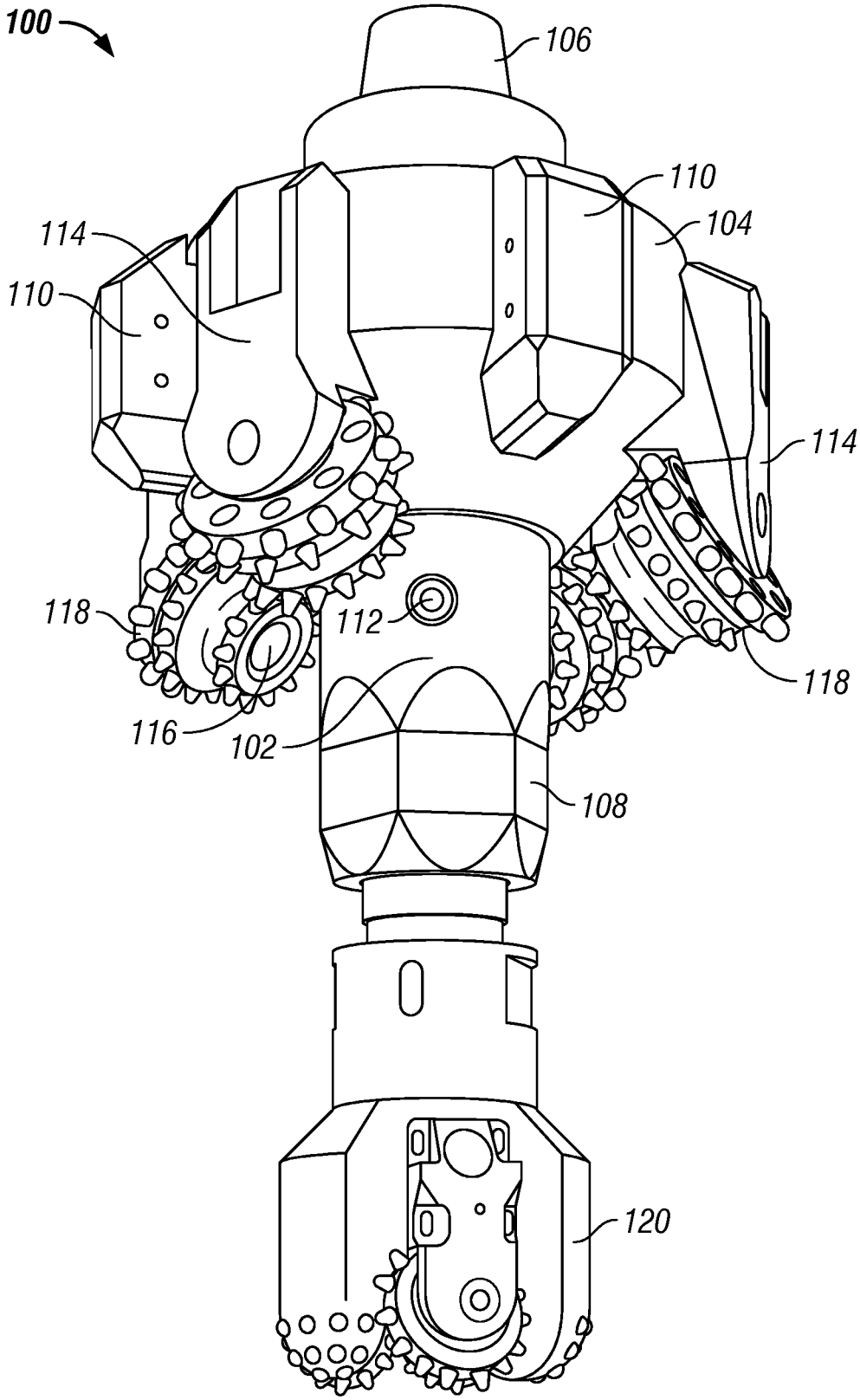
FIG. 10 illustrates one of many embodiments of the reamer having a pilot bit and utilizing certain aspects of the present invention.

FIG. 10 illustrates one of many embodiments of the reamer 100 having a pilot bit and utilizing certain aspects of the present invention. In this exemplary embodiment, the reamer 100 may include a connector 106, such as for connecting the reamer 100 to a drill string or other downhole component. The reamer may further include a body 104 coupled to a stem 102. The body 104 may be of any form, such as one or more of the embodiments described herein. For example, the body 104 may include one or more blocks 110 and/or one or more legs 114 coupled thereto or formed thereon. In the exemplary embodiment of FIG. 10, reamer 100 may include four blocks 110 and four legs 114 disposed radially around the body 104, for example, in alternating fashion. However, the reamer 100 need not, and alternatively may include any number of blocks 110 or legs 114, in any combination, as required by a particular application. The blocks 110 may be, for example, stabilizers or gauge pads, or they may include cutting elements, such as PDC cutters. One or more legs 114 may include a head 116, which may include bearings, seals, or other components for supporting cutting elements, such as a roller cone 118, for reaming a wellbore. The stem 102 may include one or more fluid orifices 112 and/or a downhole connector 108 for coupling the reamer 100 to other components in a drilling or reaming system, such as a pilot bit 120 or other equipment. The connector 108 may include threads, holes, pins, profiles, or like components, as required by a particular application. In the exemplary embodiment of FIG. 10, pilot bit 120 is shown to be a hybrid bit, but it is to be understood that pilot bit 120 may be any bit required by a particular application, such as a PDC bit, an impregnated bit, or, as another example, a roller cone bit. In one or more other embodiments, pilot bit 120 may be absent, for example, in applications including a preexisting pilot hole or wellbore. For example, reamer 100 may be coupled to another drill string component, such as a pipe or downhole tool.

Figure 11:
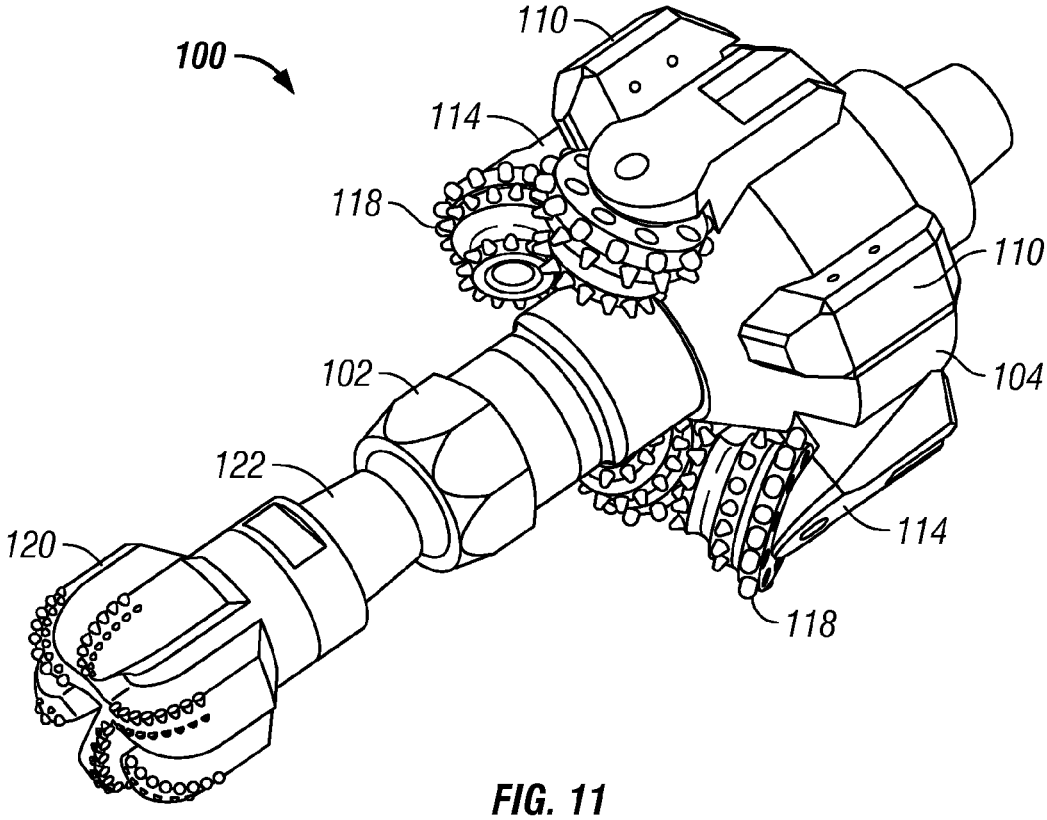
FIG. 11 illustrates another one of many embodiments of the reamer having a pilot bit and utilizing certain aspects of the present invention.
Figure 12:
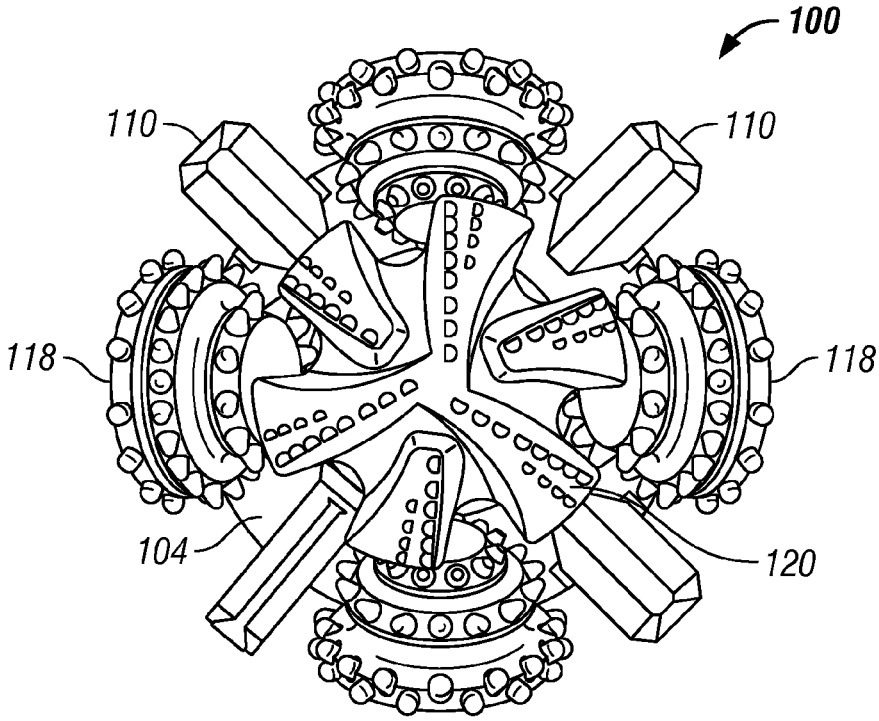
FIG. 12 illustrates another view of the embodiment of the reamer of FIG. 11 having a pilot bit and utilizing certain aspects of the present invention.

FIG. 11 illustrates another one of many embodiments of the reamer having a pilot bit and utilizing certain aspects of the present invention. FIG. 12 illustrates another view of the embodiment of the reamer of FIG. 11 having a pilot bit and utilizing certain aspects of the present invention. FIGS. 11 and 12 will be discussed in conjunction with one another. As described above, reamer 100 may include a pilot bit 120, such as, for example, a PDC bit. Pilot bit 120 may include a coupler 122, which may be any type of coupler required by a particular application. For example, coupler 122 may be used to couple pilot bit 120 to shaft 102. In the exemplary embodiment of FIGS. 11 and 12, reamer 100 is shown to include four blocks 110 and four cutting elements 118, wherein these components are radially disposed around body 104 in an alternating fashion. However, one of ordinary skill in the art will understand that reamer 100 may include any number of blocks 110 or cutting elements 118 coupled to body 104 in any order as required by a particular application. As another example, reamer 100 may include no blocks 110 or no cutting elements 118.

Figure 13:
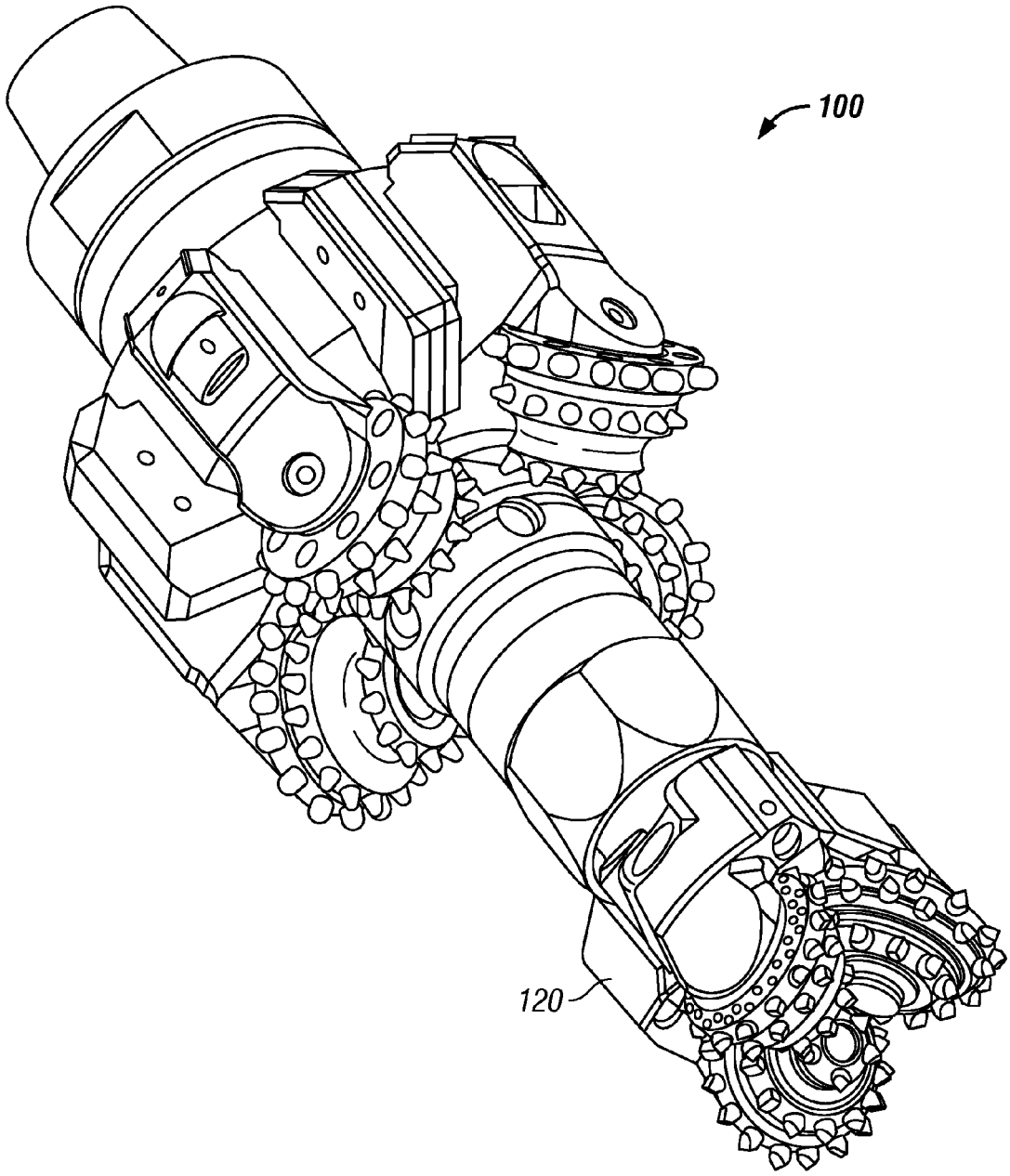
FIG. 13 illustrates another one of many embodiments of the reamer having a pilot bit and utilizing certain aspects of the present invention.

FIG. 13 illustrates another one of many embodiments of the reamer having a pilot bit and utilizing certain aspects of the present invention. As described above, for example, reamer 100 may include a pilot bit 120. In the particular embodiment of FIG. 13, pilot bit 120 is shown to be a roller cone bit, such as a tricone bit. However, the pilot bit 120 is shown to be a tricone bit for exemplary purposes only and, alternatively, could be any bit required by a particular application, including none.

Figure 14:
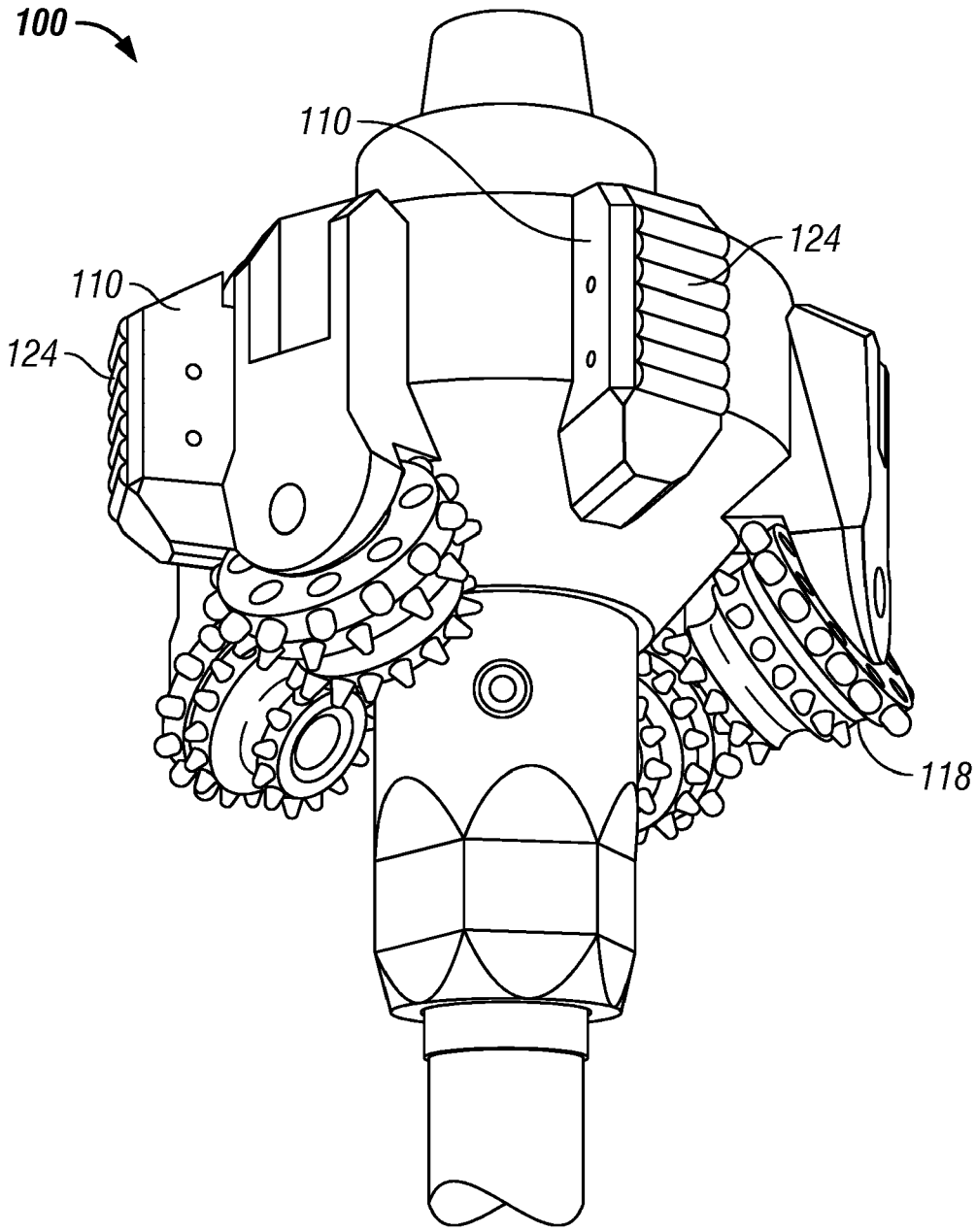
FIG. 14 illustrates another one of many embodiments of the reamer having cutters and utilizing certain aspects of the present invention.

FIG. 14 illustrates another one of many embodiments of the reamer having cutters and utilizing certain aspects of the present invention. In this exemplary embodiment, which is but one of many, reamer 100 may include a plurality of cutters 124 for reaming. For example, cutters 124 may remove material from the wall of a wellbore as reamer 100 spins downhole. The reaming may be done constantly, intermittently, or not at all, as required by a particular application. The cutters may be, for example, PDC inserts, carbide cutters, or any cutter required by a particular application. The cutters 124 may be coupled to one or more blocks 110, which may be blades. In the particular embodiment of FIG. 14, reamer 100 is shown to have both cutters 124 and cutting elements 118 for exemplary purposes only. One of ordinary skill in the art will understand that reamer 100 may include any combination of cutters 124 and cutting elements 118 as required by a particular application, including only cutters 124, only cutting elements 118, or none at all.

Other and further embodiments utilizing one or more aspects of the inventions described above can be devised without departing from the spirit of my invention. For example, the body may be coupled to the stem so that it may be removed after use and/or replaced such that the stem may be reused downhole or elsewhere. In addition, while the bodies were described herein as having a fixed diameter, the components associated therewith may be moveable or expandable, such as through the use of drilling fluid or mechanical devices. Further, the various methods and embodiments of the pilot reamer can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of my invention, but rather, in conformity with the patent laws, I intend to fully protect all such modifications and improvements that come within the scope or range of equivalent of the following claims.

What is claimed is:

1. A tool for reaming, comprising:

a tubular stem having an upper end and a lower end with a cylindrical portion therebetween, wherein each end has a connector and wherein the stem has a shoulder below the upper connector;

a body having a top and bottom, the body having a plurality of receptacles disposed radially on the outer surface thereof and having a central passage longitudinally therethrough, and wherein the body further comprises a tube coupled at least partially within the central passage for coupling the body to the stem;

at least one leg coupled to one of the receptacles, the leg having a cutting element thereon;

at least one block coupled to one of the receptacles, wherein each block and each leg are coupled to different receptacles; and wherein the body is coupled to the stem so that the top of the body is adjacent the shoulder of the stem.

2. The tool for reaming of claim 1, wherein the body comprises a plurality of plates coupled together.

3. The tool for reaming of claim 1, further comprising at least one drilling fluid port that allows fluid to pass from the interior to the exterior of the stem.

4. The tool for reaming of claim 1, wherein the at least one block is a stabilizer.

* * * * *